United States Patent [19]

Affleck et al.

[11] Patent Number: 4,946,046

[45] Date of Patent: Aug. 7, 1990

[54] APPARATUS FOR SORTING SEEDS ACCORDING TO COLOR

[76] Inventors: Sheldon Affleck; Lavern Affleck, both of Box 324, Rocanville, Saskatchewan, Canada

[21] Appl. No.: 471,022

[22] Filed: Jan. 25, 1990

Related U.S. Application Data

[63] Continuation of Ser. No. 191,906, May 9, 1988, abandoned.

[51] Int. Cl.[5] ..... B07C 5/00

[52] U.S. Cl. ..... 209/580; 209/587; 209/644; 209/912; 209/919; 209/939

[58] Field of Search ..... 204/580, 581, 582, 577, 204/587, 939, 644, 912, 919, 905, 686, 914

[56] References Cited

U.S. PATENT DOCUMENTS

| | | | |
|---|---|---|---|
| 2,152,758 | 4/1939 | Cox | 209/905 X |
| 3,058,588 | 10/1962 | Palmquist | 209/587 |
| 3,187,893 | 6/1965 | Silverman | 209/580 X |
| 3,980,180 | 9/1976 | Jamieson | 209/581 X |
| 4,221,297 | 9/1980 | ArlandaLopez et al. | 209/905 X |
| 4,414,566 | 11/1983 | Peyton et al. | 209/939 X |

FOREIGN PATENT DOCUMENTS

| | | | |
|---|---|---|---|
| 60-841 | 5/1980 | Japan | 209/580 |

*Primary Examiner*—Donald T. Hajec
*Attorney, Agent, or Firm*—Shlesinger & Myers

[57] ABSTRACT

Seeds are sorted according to color by placing the seeds in uniform rows of indentations in a rotating drum and passing the seeds beneath a digital/imaging camera and strobe lights which create images of the seeds. The images are fed to a computer, which also receives information from a drum speed sensor. The computer generates a signal which causes a blast of air to blow through an opening in the bottom of any identation containing a discolored seed to reject such seed. Rejected seeds are fed into a reject hopper, and the selected or good seeds remaining in the drum indentations fall from the drum into another hopper.

11 Claims, 2 Drawing Sheets

APPARATUS FOR SORTING SEEDS ACCORDING TO COLOR

This application is a continuation, of application Ser. No. 07/191,906, filed 5/9/88 now abandoned.

BACKGROUND OF THE INVENTION

This invention relates to an apparatus for sorting seeds, and in particular to an apparatus for sorting seeds in accordance with colour.

The sorting of seeds, i.e. the removal of bad, discoloured seeds from good seeds can be a time consuming, expensive and tedious operation. Sorting is usually a manual operation carried out on a flat conveyor.

The object of the present invention is to solve the above problem by providing a relatively simple seed sorting apparatus, which automatically and quickly sorts seeds in accordance with colour.

BRIEF SUMMARY OF THE INVENTION

Accordingly, the present invention relates to an apparatus for sorting seeds in accordance with colour comprising drum means; drive means for rotating said drum means; a plurality of indentation means in said drum means for receiving seeds, whereby one seed is positioned in each said indentation means; blower means associated with each said indentation means for dislodging individual seeds from said indentation means; camera means for creating an image of the seeds in said indentation means; and control means connected to said camera means for triggering said blower means to dislodge selected seeds.

BRIEF DESCRIPTION OF THE DRAWINGS

The invention will be described in greater detail with reference to the accompanying drawings, which illustrate a preferred embodiment of the invention, and wherein.

Figure 2:
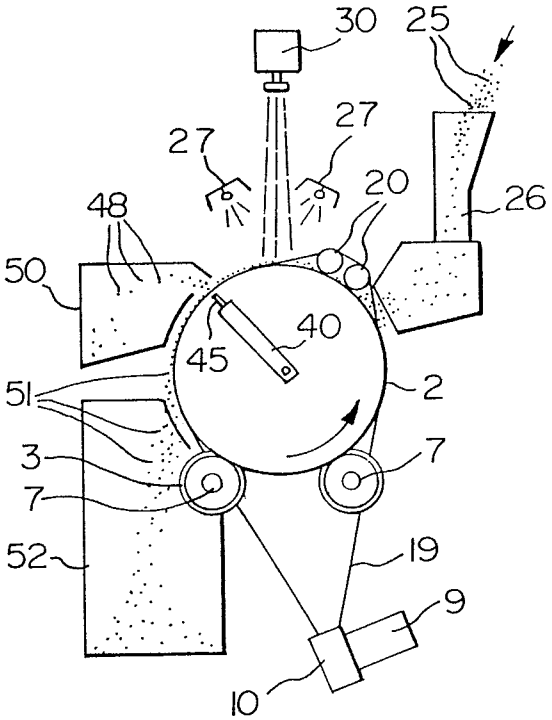
FIG. 2 is a schematic, partly sectioned end view of the apparatus of FIG. 1.
Figure 3:
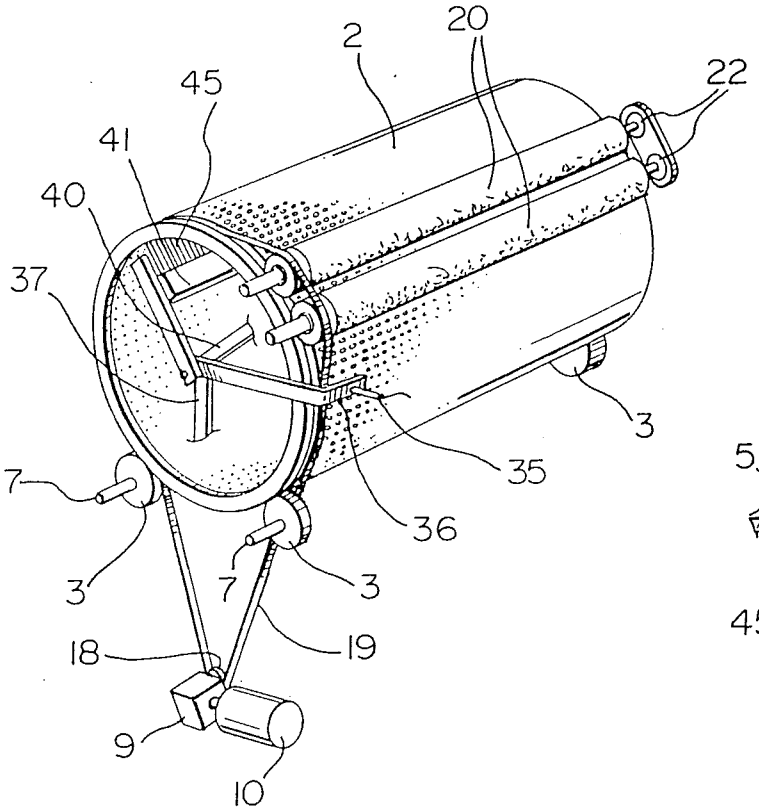
FIG. 3 is a schematic, perspective view from above and one end of a drum and rollers used in the apparatus of FIGS. 1 and 2.

It will be appreciated that, for the sake of simplicity, parts have been omitted from FIGS. 2 and 3.

DESCRIPTION OF THE PREFERRED EMBODIMENT(S)

Figure 1:
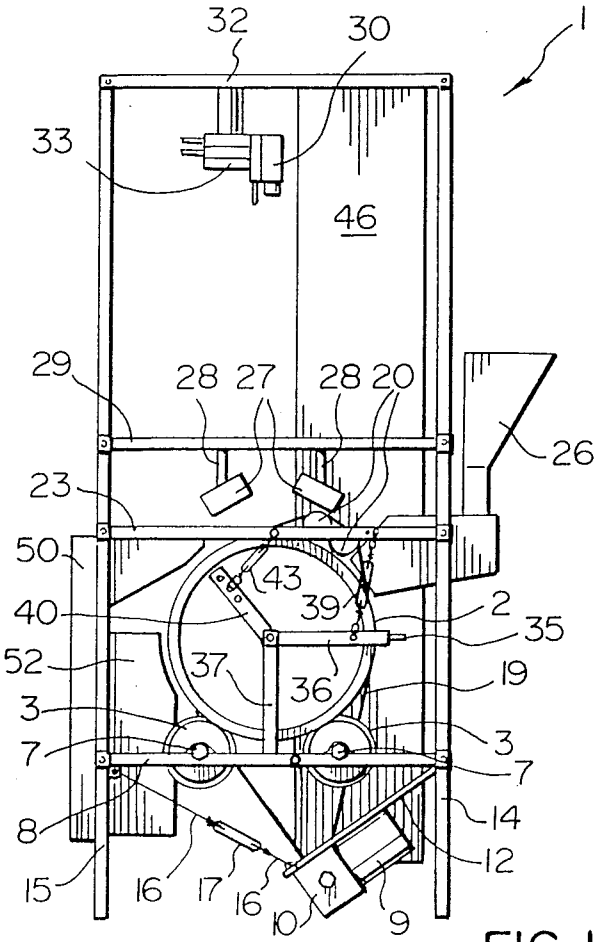
FIG. 1 is an end elevational view of a seed sorting apparatus in accordance with the invention.

Referring to FIGS. 1 and 2, the apparatus of the present invention includes a skeletal, rectangular frame generally indicated at 1 for carrying most of the remaining elements of the apparatus. A hollow, cylindrical, metal drum 2 is rotatably mounted on four rollers 3 (three shown—FIG. 3) in the frame 1. The drum 2 includes a plurality of parallel, longitudinally extending rows of shallow, concave recesses 4 (FIG. 4) for receiving seeds (not shown). An opening 5 is provided at the bottom centre of each recess 4. The rollers 3 are mounted on stub axles 7 extending inwardly from crossbars 8 (one shown) at each end of the frame 1. The drum 2 is rotated by an electric motor 9 and transmission 10 which are mounted on an inclined plate 12. One end of the plate 12 is connected to one corner leg 14 of the frame 1, and the other end of the plate is suspended from another leg 15 of the frame by cables 16 and a turnbuckle 17. A pulley 18 (FIG. 3) is connected to the transmission 10 for driving a belt 19, which extends around the drum 2 and around a pair of brush rollers 20. Thus, the motor 9 rotates the drum 2 and the rollers 20. The rollers 20 are mounted in bearings 22 (one set shown) on a top crossbar 23 for bearing against the drum 2.

Seeds 25 are fed onto the drum through a hopper 26 mounted on one side of the drum 2. The seeds 25 drop into the recesses 4 to fill all of the recesses. As the recesses 4 pass beneath the brush rollers 20, any seeds not in a recess 4 are brushed from the surface of the drum 2. The seeds then pass beneath sets of strobe lights 27 on the ends of arms 28 suspended from crossbars 29 (one shown). The lights 27 are arranged in rows extending the entire length of the drum 2. The rows of seeds also pass beneath a digital/imaging camera 30 suspended from the top 32 of the frame. As mentioned, the camera 30 is a digital/imaging camera, which takes an optical image and converts the image directly to a digital image for transfer to a computer (not shown). The camera 30 is suspended on a four-way micrometer bracket assembly 33, so that the camera can be moved very precisely in any direction to focus and centre over a row of seeds on the drum 2.

Additional information is fed to the computer from a proximity probe sensor 35 (FIG. 3), which is on an L-shaped arm 36, so that the sensor analyzes the first peripheral row of recesses 4 at one end of the drum 2. The sensor 35 measures differences in its proximity to metal. In this case, the sensor is used to sense the passing of the rows of recesses 4 on the surface of the drum 2. This information is used by the computer to correlate all distance related operations. The other end of the arm 36 is pivotally connected to a post 37 extending upwardly from the centre of one of the crossbars 8. A turnbuckle 39 extends between the arm 36 near the sensor 35 and the crossbar 23 to permit adjustment of the sensor location.

A second arm 40 extends upwardly from the opposite side of the post 37 for supporting one end of a manifold 41, which extends through the drum 2. The other end of the manifold 41 is supported by a post and arm arrangement (not shown) similar to the post 37 and the arm 40. One end of the arm 40 is pivotally connected to the top end of the post 37, and the other end is supported by a turnbuckle 43, which is also connected to the crossbar 23.

Figure 4:
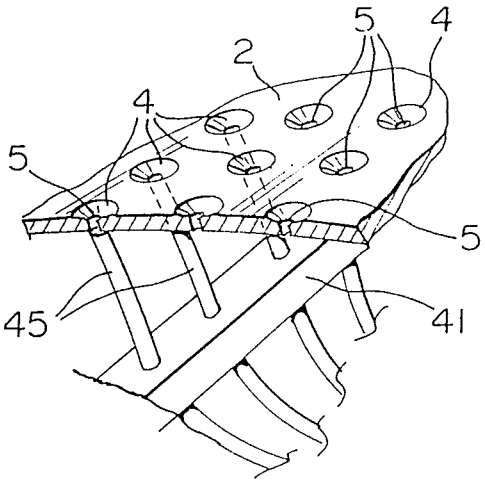
FIG. 4 is a schematic, perspective view of a section of the drum of FIG. 3 on a larger scale.

As best shown in FIG. 4, the manifold 41 carries a plurality of nozzles defined by tubes 45. The number of tubes 45 extending through the manifold is equal to the number of recesses 4 or openings 5 in each longitudinal row of recesses on the drum 2. Thus, any or all of the seeds in the recesses could be blown out of the recesses as the row of recesses containing such seeds passes the tubes 45. A valve (not shown) is provided in each tube 45, such valve being housed in a casing 46 (FIG. 1) mounted on one end of the frame 1. The tubes are bundled together and pass through one end of the drum 2 from the casing 46 to the manifold 41.

Seeds 48 rejected by the apparatus, i.e. seeds having the wrong colour as detected by the camera 30 are blown into a discharge hopper 50. The remaining, selected seeds 51 fall from the drum into another discharge hopper 52.

The operation of the apparatus will be described with reference to FIG. 2. In use, seeds 25 are fed into the hopper 26 for transfer to the rotating drum 2. The drum and seeds pass beneath the rollers 20, which remove any seeds not located in indentations 4. The seeds thus removed can be recycled, i.e. returned to the hopper 26. At approximately the top dead centre position of the drum, the uniform rows of seeds 25 in the indentations 4 pass beneath the strobe lights 27 and the digital/imaging camera 30 which takes a picture, i.e. creates an image. Each image covers an area of 320 indentations 4 in the drum 2. The strobe lights 27 function in coordination with the camera 30 to enable each frame or image to be taken without blur. Each image is analyzed by the computer, which correlates the image with the location of each indentation.

Such location information is supplied by the sensor 35 (FIGS. 1 and 3). A decision is made to either reject of accept the contents of each indentation 4. The information is stored in the computer memory until the drum 2 moves to approximately 30 degrees beyond top dead centre. In this position, if a seed is to be rejected an air blast passes through the tube 45 and the opening 5 to eject the seed 48 from the indentation 4 into the hopper 50.

Any seeds 51 not ejected from the drum 2 by air blasts are dislodged by gravity into the selected seed hopper 52.

Movement of the drum 2 and seed sorting are continuous, and are presently limited only by the processing capability of the computer. A rate of twenty-two images per second has already been achieved and can be increased by the use of improved computer technology.

What is claimed is:

1. An apparatus for sorting seeds according to color, comprising:

(a) drum means including a peripheral wall having an external peripheral surface;

(b) said peripheral surface having a width;

(c) said peripheral wall having a thickness;

(d) a plurality of seed receiving means disposed in rows extending across the width of said peripheral surface and each receiving an individual seed therein;

(e) each of said seed receiving means including indentation means;

(f) said indentation means comprising generally cup-shaped recesses extending substantially through the thickness of the peripheral wall of said drum means and for holding therein an individual seed by the force of gravity;

(g) means associated with each of said seed receiving means for dislodging individual seeds therefrom;

(h) digital imaging means for creating an image of a portion of the peripheral surface of said drum means including at least one row of seeds;

(i) means for analyzing said image for determination of differences in seed color in said at least one row of seeds and comparing color differences of seeds against a predetermined standard;

(j) means for selectively operating said dislodging means for ejecting seeds which do not conform to said predetermined standard from respective seed receiving means;

(k) first hopper means disposed on one side of and for feeding seeds to said drum means by the force of gravity;

(l) second hopper means disposed opposite to said first hopper means for receiving seeds that do not conform to said predetermined standard;

(m) two-roller brush means disposed external to said drum means and positioned between said first hopper means and said digital imaging means for uniformly distributing the seeds over the peripheral surface of said drum means; and (n) single drive means for rotating both said drum means and said two-roller brush means.

2. An apparatus according to claim 1, and including:

(a) third hopper means for accepting seeds released by the force of gravity and that meet said predetermined standard separately from and subsequently to ejecting seeds that do not conform to said predetermined standard.

3. An apparatus according to claim 1, wherein:

(a) said drive means rotates said drum means continuously without interruptions.

4. An apparatus according to claim 1, wherein:

(a) each of said dislodging means includes blower means;

(b) said digital imaging means includes camera means; and (c) said operating means includes control means.

5. An apparatus according to claim 4, wherein: said two-roller brush means removes excess seeds from said drum means before the seed-containing indentation means reach the position of said camera means.

6. An apparatus according to claim 4, including strobe light means associated with said camera means for illuminating a selected area of said drum means to facilitate creation of the image thereof.

7. An apparatus according to claim 6, wherein said control means includes sensor means for sensing the speed of rotation of said drum means, whereby actuation of said blower means is correlated to positioning of said indentation means containing the selected seeds over said blower means.

8. An apparatus according to claim 7, including an opening in the bottom of each indentation means; and nozzle means equal in number to the number of indentation means and openings in the area photographed by said camera means during the creation of each image.

9. An apparatus according to claim 8, wherein said nozzle means define a row inside of said drum means.

10. An apparatus according to claim 4, wherein:

(a) said recesses having top openings lying generally coplanar with said peripheral surface.

11. An apparatus according to claim 10, wherein:

(a) said recesses are sized so as to receive only one seed therein.

* * * * *